United States Patent [19]

Ishino

[11] Patent Number: 4,869,712

[45] Date of Patent: Sep. 26, 1989

[54] PAPER FOLDING APPARATUS

[75] Inventor: Masahiro Ishino, Saitama, Japan

[73] Assignee: Fuji Xerox Co., Ltd., Tokyo, Japan

[21] Appl. No.: 110,350

[22] Filed: Oct. 20, 1987

[30] Foreign Application Priority Data

Mar. 31, 1987 [JP] Japan ..... 62-75997

[51] Int. Cl.[4] ..... B65H 45/12; B65H 29/16; B65H 45/20

[52] U.S. Cl. ..... 493/416; 493/413; 493/460; 270/39

[58] Field of Search ..... 493/416, 436, 442, 454, 493/411, 412, 413, 414, 415, 442, 460, 461, 424, 425, 426, 427, 428, 420, 421; 270/39, 45

[56] References Cited

U.S. PATENT DOCUMENTS 722,879 3/1903 Owens ..... 493/420
2,253,446 8/1941 Spiess ..... 270/68
4,484,905 11/1984 Ashburner ..... 493/415

FOREIGN PATENT DOCUMENTS 0189986 8/1986 European Pat. Off. .
1105631 3/1968 United Kingdom .
2054529 2/1981 United Kingdom .
2086858 5/1982 United Kingdom .

*Primary Examiner*—Frederick R. Schmidt
*Assistant Examiner*—Jack W. Lavinder
*Attorney, Agent, or Firm*—Finnegan, Henderson, Farabow, Garrett, & Dunner

[57] ABSTRACT

Apparatus for folding paper fed from either an automatic or manual paper source. Paper is conveyed from an appropriate input inlet through one of two paths to a folding apparatus where it is accumulated between roller pairs. When the folding is complete, the folded paper is discharged from the apparatus.

11 Claims, 1 Drawing Sheet

PAPER FOLDING APPARATUS

BACKGROUND OF THE INVENTION

1. Field of the Invention

The present invention relates to a paper folding apparatus and related method for automatically folding paper, and particularly to a paper folding apparatus having one conveyance path for feeding automatically inserted paper from a paper supply to a folding mechanism portion and another conveyance path for feeding manually inserted paper to the same folding mechanism portion.

2. Description of the Prior Art

In the conventional on-line paper folding apparatus, paper fed from a paper supply of a large-sized copying machine or the like is folded by an automatic paper folding apparatus connected to the paper supply. When paper is manually inserted for folding, the paper is conveyed through an insertion inlet to the folding mechanism portion using the same conveyance path as was used for the automatic mode.

In the conventional paper folding apparatus, as described above, manually inserted paper is passed through the same conveyance path as is paper fed through automatically. This use of the same path causes a problem because the conveyance path that passes between the copying machine and the folding mechanism portion of the paper folding apparatus is quite long. Therefore, it is impossible to manually insert paper when the copying machine is directly connected to the folding mechanism portion.

SUMMARY OF THE INVENTION

The present invention overcomes the problems and disadvantages of the prior art by having one conveyance path for automatically fed paper and another conveyance path for manually fed paper.

An object of the present invention is to provide a paper folding apparatus in which paper feeding to the paper folding apparatus can be carried out through both automatic and manual insertion.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention as embodied and broadly described herein, the invention comprises a means for folding paper, a first conveyance path communicating with the paper folding means for conveying paper to the paper folding means, a driving mechanism causing the conveyance of paper along the first conveyance path to the paper folding means, a second conveyance path communicating with the paper folding means for conveying paper to the paper folding means, a Y-shaped path having one leg of the yoke aligned with the first conveyance path and one leg of the yoke aligned with the second conveyance path for selectively receiving paper from both paths, the base leg of the Y-shaped path communicating with the paper folding means.

Additionally, the invention comprises a paper folding apparatus for folding paper comprising a paper folding mechanism, a first conveyance path for conveying paper to the paper folding mechanism, an automatic insertion inlet in communication with the folding mechanism, an openable/closable automatic insertion gate disposed near the automatic insertion inlet, and a second conveyance path capable of conveying paper to the folding mechanism when the automatic insertion gate is closed.

The accompanying drawings, which are incorporated in and constitute a part of this specification, illustrate one embodiment of the invention and together with the description, serve to explain the principles of the invention.

BRIEF DESCRIPTION OF THE PREFERRED EMBODIMENTS

Figure 1:
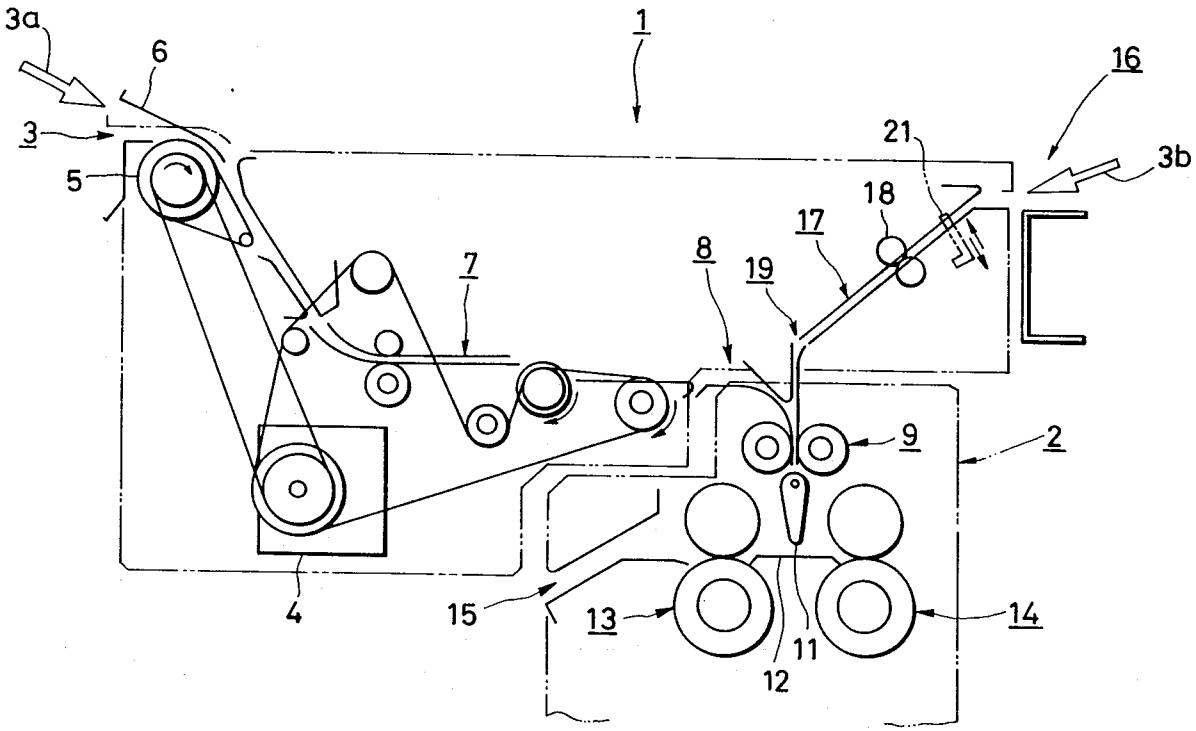
FIG. 1 is a schematic cutaway side view of a preferred embodiment of the paper folding apparatus.

Reference will now be made in detail to the present preferred embodiment of the invention, an example of which is illustrated in the accompanying drawings.

The paper folding apparatus illustrated in FIG. 1 comprises a conveyer 1 for conveying paper into the apparatus and a folding mechanism portion 2 for folding the paper. An automatic insertion inlet 3 for paper conveyed from an automatic paper conveying source 3a is disposed at a left upper portion of the conveyer 1. The automatic insertion inlet 3 comprises a roller 5 arranged to be rotated by a driving source 4, and an openable/-closable automatic insertion gate 6. In the case where paper is folded in an automatic mode, the automatic insertion gate 6 is opened so that paper from a paper supply is inserted through the automatic insertion inlet 3. The paper inserted through the automatic insertion inlet 3 is passed through a first conveyance path 7 to an automatic side inlet 8 at an upper portion of the folding mechanism portion 2 and inserted into a feed roller pair 9 of the folding mechanism portion 2.

The paper inserted through a guide member 11 is passed through the feed roller pair 9 and is in turn inserted alternately between folding roller pairs 13 and 14 owing to the swinging of the lower end of the guide member 11 as well as the guiding by a guide plate 12. After folding, the paper is discharged out of the machine through a discharging outlet 15.

When paper is folded in manual mode, paper is manually inserted onto a second conveyance path 17 through a manual insertion inlet 16 from a manual paper conveying source 3b. At that time, the paper is inserted with the back surface facing up in order to make the paper agree in orientation with paper to be folded in the automatic mode. The paper is then inserted by a roller pair 18 into the feed roller pair 9 of the folding mechanism portion 2 through a manual side inlet 19. The paper sent out of the feed roller pair 9 is folded in the same manner as the case in the automatic mode.

In the case where the paper folding operation is not carried out while copying is occurring, the automatic insertion gate 6 of the conveyer 1 is made to be in the closed state so that insertion of paper through the automatic insertion inlet 3 is prevented. When the automatic insertion gate 6 is closed, the second conveyance path 17 is opened by a stopper 21 for opening/closing the second conveyance path 17, and an indication lamp, buzzer or the like for indicating that manual insertion can take place is activated. Under the control of software for controlling the copying machine and the paper folding apparatus, it is possible to perform copying in the copying machine and to insert paper through the manual insertion inlet 16 so as to independently operate the folding mechanism portion 2 with manual insertion. Thus, it is possible to perform the folding operation through manual insertion at the same time that a copying operation is being performed by the copying machine.

Other embodiments of the invention will be apparent to those skilled in the art from consideration of the specification and practice of the invention disclosed herein. It is intended that the specification and examples be considered as exemplary only with a true scope and spirit of the invention being indicated by the following claims.

What is claimed is:

1. An apparatus for folding paper that is either automatically or manually inserted into the apparatus, comprising:

means for folding paper;

a first conveyance path communicating with said paper folding means for conveying paper to said paper folding means;

a driving mechanism causing said conveyance of paper along said first conveyance path to said paper folding means;

a second conveyance path having an inlet and an outlet at opposing ends of said second conveyance path, said inlet for allowing paper to enter said second conveyance path, said outlet for enabling paper to exit said second conveyance path, and communicating with said paper folding means for conveying paper to said paper folding means; and a Y-shaped path having a base leg and a yoke with first and second legs, said first leg of the yoke being aligned with said first conveyance path and said second leg of the yoke being aligned with said second conveyance path, for selectively receiving paper from both paths, the base leg of said Y-shaped path communicating with said paper folding means.

2. The apparatus of claim 1 wherein said paper folding means comprises:

first roller means for receiving paper from said first and second conveyance paths;

a plurality of second roller means for directing paper from said first roller means into a folded pile;

a guidance arm for selectively directing paper from said first roller means to ones of said plurality of second roller means, said guidance arm having a first and second end and being fixed at said first end and freely rotating at said second end and a guidance plate disposed between said plurality of second roller means, said guidance plate for guiding paper from said guidance arm to said plurality of second roller means.

3. The apparatus of claim 1 wherein said paper folding means comprises a opening in said means for allowing said folded paper to be discharged from the apparatus.

4. The apparatus of claim 1 wherein said first conveyance path comprises:

inlet means for allowing paper to enter said firs conveyance path;

blockage means disposed adjacent to said inlet means for selectively denying entrance to paper via said inlet means; and a roller for conveying paper away from said inlet means and toward said paper folding means, said roller being responsive to said driving mechanism.

5. The apparatus of claim 1 wherein said second conveyance path comprises:

blockage means disposed adjacent to said second conveyance path inlet for selectively denying an entrance to paper via said second conveyance path inlet; and roller disposed adjacent to said second conveyance path for directing paper to said paper folding means.

6. A paper folding apparatus having a folding mechanism portion for folding paper comprising:

a paper folding mechanism;

a first conveyance path for conveying paper to said paper folding mechanism;

an automatic insertion inlet in communication with said folding mechanism;

an openable/closable automatic insertion gate disposed near said automatic insertion inlet; and a second conveyance path capable of conveying paper to said folding mechanism when said automatic insertion gate is closed.

7. A method for folding paper comprising:

selectively inputting said paper from an automatically operated paper source to a first conveyance path;

conveying said paper along said first conveyance path to a first leg of a yoke of a Y-shaped path, said Y-shaped path having said first leg aligned with said first conveyance path;

selectively inputting said paper from a manually operated paper source to a second conveyance path;

conveying said paper along said second conveyance path via a roller to a second leg of the yoke of said Y-shaped path, said Y-shaped path having said second leg aligned with said second conveyance path;

conveying said paper via a base leg of said Y-shaped path from one of said first or second conveyance paths to a paper folding means adjacent to said base leg; and folding said paper in the paper folding means.

8. The method of claim 7 wherein selectively inputting said paper into said first conveyance path comprises:

removing a blockage disposed adjacent to said first conveyance path from said path, responsive to the presence of paper in said automatically operated paper source; and inserting paper into said first conveyance path from said automatically operated paper source through an inlet aligned with said first conveyance path.

9. The method of claim 7 wherein conveying said paper along said first conveyance path comprises:

propelling paper along said first conveyance path, via a driven roller disposed adjacent to said path; and activating said driven roller via a circular belt, a first end of said belt contacting a peripheral edge of said driven roller and a second end contacting an opposite peripheral edge of a powered roller.

10. The method of claim 7 wherein selectively inputting paper into said second conveyance path comprises:

removing a blockage disposed adjacent to said second conveyance path from said path responsive to the absence of paper in said automatically operated paper source; and inserting paper from a manually operated paper source through an inlet aligned with said second conveyance path into said second path.

11. The method of claim 7 wherein folding said paper comprises:

conveying said paper from said base of said Y-shaped path through a longitudinal section of a swinging guidance arm adjacent to said path and having a first and a second end, said guidance arm being fixed at said first end and freely rotating at said second end;

selectively directing said paper from said guidance arm to one of said plurality of roller pairs via a guidance plate disposed between said plurality of roller pairs to fold said paper;

discharging said folded pile of paper via an opening adjacent to at least one of said roller pairs.

* * * * *